United States Patent [19]

Gray et al.

[11] Patent Number: 4,519,451

[45] Date of Patent: May 28, 1985

[54] WELL TREATING EQUIPMENT AND METHODS

[75] Inventors: Floyd R. Gray, Flower Mound; Dennis D. Rood, Carrollton, both of Tex.

[73] Assignee: Otis Engineering Corporation, Dallas, Tex.

[21] Appl. No.: 493,147

[22] Filed: May 9, 1983

[51] Int. Cl.[3] ..... E21B 43/04

[52] U.S. Cl. ..... 166/278; 166/51; 166/131; 166/205; 166/386

[58] Field of Search ..... 166/278, 373, 386, 387, 166/312, 51, 56, 102, 126, 131, 133, 331, 143, 144, 158, 181, 184, 188, 205, 120

[56] References Cited

U.S. PATENT DOCUMENTS

| | | | |
|---|---|---|---|
| 3,627,046 | 12/1971 | Miller | 166/278 |
| 3,710,862 | 1/1973 | Young et al. | 166/278 |
| 3,850,246 | 11/1974 | Despujols | 166/51 |
| 3,987,854 | 10/1976 | Callihan et al. | 166/278 |
| 4,044,832 | 8/1977 | Richard et al. | 166/143 |
| 4,180,132 | 12/1979 | Young | 166/120 |
| 4,295,524 | 10/1981 | Baker et al. | 166/278 |
| 4,296,807 | 10/1981 | Hendrickson et al. | 166/184 |

*Primary Examiner*—Stephen J. Novosad
*Assistant Examiner*—William P. Neuder
*Attorney, Agent, or Firm*—Albert W. Carroll

[57] ABSTRACT

Improved equipment and methods for treating wells by processes such as acidizing, gravel packing, and the like, wherein provision is made for removing the excess acid, gravel, and the like, from the well while the work string or pipe, on which the equipment is run into the well, remains connected to the well packer. The pipe string is disconnected from the packer only when it is ready to be removed from the well. Provision is also made for repeating the cleanout operation any number of times, making it possible to perform a series of treating operations during a single trip into the well and removing the excess treating medium after each such treating operation in the series.

35 Claims, 19 Drawing Figures

WELL TREATING EQUIPMENT AND METHODS

BACKGROUND OF THE INVENTION

1. Field of the Invention

This invention relates to well tools and more particularly to the treating of subterranean formations in wells by processes known as acidizing, gravel packing, formation fracturing, and the like processes, for sand control and/or increased production, such as of hydrocarbons.

2. Description of the Prior Art

It has been known to treat wells, such as oil or gas wells, with treating media, such as acids, plastics, cements, sand or gravel-laden liquids, and the like fluids, for the purpose of controlling sand, paraffin, or the like, or for increasing productivity of the producing formations, et cetera. It is common to perform a plurality of such operations in sequence. For instance, it is common to treat a well with acid (to acidize) before performing a gravel packing operation, or before performing a sand fracturing and propping operation. Further, it is common to perform a plurality of operations in sequence, wherein one or a plurality of liquids is forced into the producing formation. Furthermore, it is common practice to remove excess treating fluids from a well immediately after such individual operations. Oftentimes, it is necessary to disconnect the pipe string from the packer in order to remove such excess treating fluids. (This removal is generally accomplished by reverse circulation, as opposed to conventional circulation.) After the pipe string has been disconnected from the packer, it has not been practical to reconnect it again for performing additional treating operations, since there was a great risk that seals or equipment downhole would be damaged and their functioning made questionable, and there was a risk that pressures would lift the apparatus out of position during the treatment. Consequently, it has been common practice to withdraw the pipe string, redress the equipment, and rerun it into the well. Also, in lifting the pipe string relative to the packer in order to reverse circulate to effect removal of excess treating fluids, seals normally engaged in the packer bore are disturbed, or moved a long ways out of place, or are completely removed from the packer, thus exposing the internal wall of the packer to hostile agents such as acids which might damage this inner wall to such extent that seals will no longer sealingly engage therein, or be roughened to such extent that the seals will be abraded and ruined as they are forced into place in the packer bore.

The present invention is embodied in equipment which permits sequential operations to be carried out in a well by treating the well with a plurality of treating media and reverse circulating cleanout fluids after each phase of treatment without disconnecting the pipe string from the packer and without moving the seals in the packer bore.

Known prior art which relates to this present invention includes the following U.S. Pat. Nos.: 3,398,795 3,710,862 3,893,512 4,180,132 4,321,965.

U.S. Pat. No. 3,398,795 which issued to Thomas L. Elliston for RETRIEVABLE WELL PACKERS on Aug. 27, 1968, teaches use of a retrievable well packer having slips for locking the packer in the well casing against displacement therein in either longitudinal direction, this packer being typical of packers adaptable for use in practicing the present invention.

U.S. Pat. No. 3,710,862 issued on Jan. 16, 1973 to Carter R. Young, et al, for METHOD AND APPARATUS FOR TREATING AND PREPARING WELLS FOR PRODUCTION. The present invention is an improvement over the methods and apparatus taught in this patent.

U.S. Pat. No. 3,893,512 which issued July 8, 1975 to Albert W. Carroll, et al, for METHOD AND APPARATUS FOR CONTROLLING FLOW FROM WELLS, shows a telescoping joint used downhole in a pipe string to provide limited relative longitudinal movement.

U.S. Pat. No. 4,180,132 issued Dec. 25, 1979 to Carter R. Young for SERVICE SEAL UNIT FOR WELL PACKER. The present invention is an improvement over the service seal unit tool disclosed in this patent.

None of the prior art of which applicants are aware shows apparatus for performing treating operations such as acidizing, gravel packing, or the like operation in a well wherein the excess treating medium is removed via reverse circulation of cleanout fluids without disconnecting the pipe string from the packer and without substantially moving the seals in or from the packer bore during the treating operation.

SUMMARY OF THE INVENTION

The present invention is directed to well treating equipment and methods wherein a packer and a screen are connected together and have means providing lateral openings therebetween, and a service seal unit tool installed in the packer with seal means thereon sealingly engaging the packer wall above and below the lateral openings, the packer-screen combination being lowered into the well on a pipe string, and the packer set above the well portion to be treated, an initial circulation path is established, and the selected well portion is treated with treating medium, after which another circulating path is established responsive to lifting the pipe string while the seals sealing between the service seal unit tool and the packer remain in sealing position and substantially unmoved and the excess treating medium is removed by circulation through the packer. Only after the treating operation has been completed is the service seal unit tool disconnected from the packer, but even then, only if it is desired to remove the service seal unit tool from the well.

It is therefore one object of this invention to provide a service seal unit tool which is connectable to a pipe string and to a packer/screen combination and which is provided with seals engageable in the packer bore, and including a lost motion device whereby after the packer has been set in a well, an initial circulating path is established from the surface through the packer to the exterior of the screen, through the screen and return to the surface for depositing treating medium below the packer and then, in response to lifting the pipe string, establishing a different flow path for circulating cleanout fluids from the surface, through the packer, and return to the surface for removing excess treating medium from the well, this lifting of the pipe string being accomplished while the pipe string remains connected to the packer and while the seals of the service seal unit tool remain engaged in the packer bore and substantially unmoved.

Another object is to provide a service seal unit tool of the character described wherein the connection between the service seal unit tool and the packer is releasable.

Another object is to provide such a tool wherein this releasable connection means includes at least one shear pin.

A further object is to provide such a tool wherein the lost motion device includes telescoped members having shoulders to limit the stroke of the mechanism and seal means sealing between the telescoped members to prevent leakage of fluids.

Another object is to provide a service seal unit tool of the character described having a flow tube therein having its lower end opening into the interior of the screen and its upper end opening through the side wall of said tool above the lost motion mechanism.

A further object is to provide such a tool wherein an annular seal is provided to seal between the flow tube and the screen, and upon lifting the pipe string the lost motion device is extended and the annular seal between the flow tube and the screen is disengaged.

Another object is to provide such a tool having lateral openings between the packer and the screen and seals carried on the tool seal between the tool and the packer both above and below the lateral openings.

A further object is to provide a service seal unit tool of the character set forth having a valve therein for closing off the return flow through the flow tube to permit applying fluid pressure through the pipe string and packer to the well therebelow.

Another object is to provide such a tool wherein the valve therein is a sleeve valve which opens and closes in response to lifting and lowering the pipe string.

Another object is to provide such a tool wherein the valve comprises telescoped members and includes a sleeve which is movable up and down by lifting and lowering the pipe string and which thus covers and uncovers the opening at the upper end of the flow tube, and including seals for preventing leakage of fluids through the sleeve valve.

Another object is to provide such a tool wherein the telescoped members of the valve are provided with a control slot on one member and a control pin is provided on another member and is engaged in the control slot, and the slot is contoured to provide both long and short stroke limits such that one time lifting of the pipe string will open the valve (long stroke) and lowering the pipe string will close the valve, while on a subsequent lifting of the pipe string the valve will stop short of opening position (short stroke), thus remaining in closed position.

A further object is to provide such a tool wherein the flow tube extends to a point intermediate the ends of the screen and has its lower end sealed thereabout between it and the screen by a seal and a seal is also provided about the flow tube at a location between the upper end of the screen and the lateral openings.

A further object is to provide such a tool wherein a safety joint is provided in the flow tube near the lower end thereof but above the lowermost seal which is separable upon an upward pull of predetermined magnitude enabling the tool to be withdrawn from the well should the lower portion of the flow tube become fouled in the screen.

Another object of this invention is to provide a tool of the character set forth wherein the telescoped members providing the lost motion are initially releasably secured in retracted position, including securing them together with shear means such as shear pins.

Another object is to provide such a tool wherein the telescoped members providing the lost motion are releasably secured in retracted position by relatchable means such as an "L" slot in one member and a pin in the other member projecting into the "L" slot, this connection being latchable and releasable in response to rotational movement of the pipe string.

Another object of this invention is to provide a method of treating a well such as a well having a casing therein perforated opposite a selected formation, the method including lowering apparatus into a well on a pipe string, the apparatus including a well packer connected to a screen with means providing lateral openings therebetween, and a service seal unit tool connected between the packer and the pipe string, the tool having seals engaged in the packer bore above and below the lateral openings, setting the packer above the casing perforations, lifting the pipe string to establish a first flow path for circulating fluids from the surface downwardly through the pipe string, packer and lateral openings to the exterior of the screen, through the screen, and from the interior of the screen to the surface, then lifting the pipe string to a higher level to establish a second flow path for circulating fluids from the surface downwardly through the pipe string and packer and back to the surface, this lifting of the pipe string being accomplished while the tool remains attached to the packer and the tool seals engaged in the packer bore remain engaged therein and substantially unmoved.

Another object is to provide such a method wherein the tool is released from the packer and is removed from the well.

Another object is to provide a method of the character just described wherein a production tubing with a production seal nipple with seal means thereon is lowered into the well and the seal nipple is inserted in the packer so that its seals engage the packer bore above and below the lateral ports, after which the well is produced through the seal nipple and the tubing.

Other objects and advantages will become apparent from reading the description which follows and from studying the accompanying drawing wherein:

DESCRIPTION OF THE PREFERRED EMBODIMENTS

Figure 1:
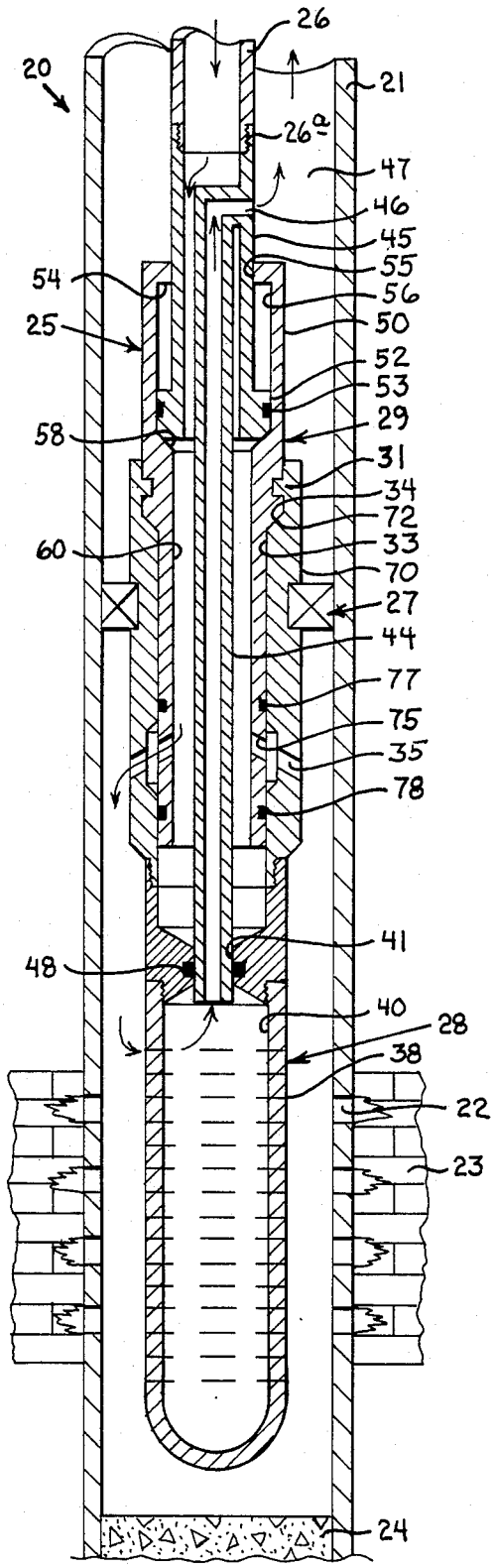
FIG. 1 is a schematical view of the lower portion of a well with the apparatus of this invention in place for practicing the well treating method of this invention.
Figure 2:
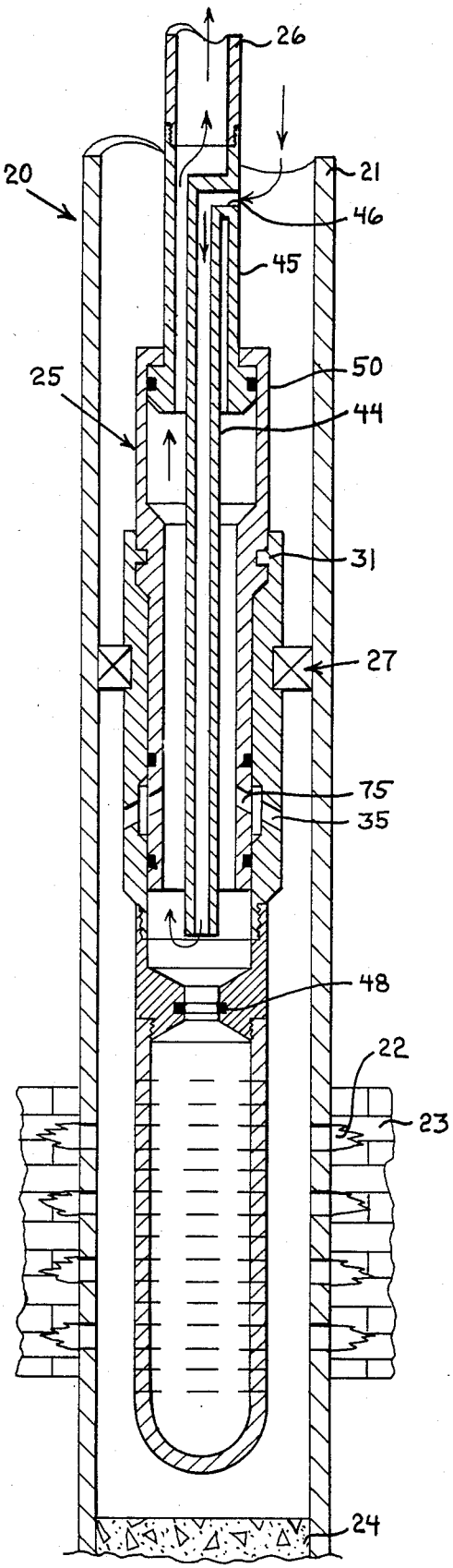
FIG. 2 is a schematical view similar to FIG. 1 showing the apparatus in position to perform a later step in the well treating method.

Referring now to FIGS. 1 and 2, it will be seen that a well 20 is shown to be provided with casing 21 perforated as at 22 opposite a subterranean formation 23 which may represent an oil or gas production zone. The bottom of the well 20 is represented by the cement plug 24 located just below the formation 23.

Apparatus of this invention is installed in the casing 21 and is indicated generally by the reference numeral 25. This apparatus was lowered to the level shown on a pipe string, or tubing 26 to which it is attached by suitable means such as the thread 26*a*. The apparatus includes a well packer 27 to the lower end of which is attached a well screen 28 and in which is engaged a service seal unit tool 29. The tool 29 is attached to the packer as at 31, and it is preferable that this connection be releasable for a purpose which will be later brought to light.

The packer 27 has a smooth bore 33, near the upper end of which is an upwardly facing shoulder 34 and, near its lower end, lateral ports or openings 35 which open inwardly into a recess in the wall of bore 33 and open outwardly into the casing below the packer. The lateral openings, if desired, may be formed in a connector member used to couple the packer 27 to the screen 28.

The screen 28 is provided with slits or narrow openings 38 through its wall which permit fluids to enter the screen but which will exclude particulate matter such as coarse sand or fine gravel often packed thereabout or carried in flowing fluids. Near the upper end of the screen, the bore 40 thereof is reduced as at 41 for a purpose soon to be disclosed.

The service seal unit tool 29 is provided with a small-diameter internal flow tube or wash pipe 44 having its upper end opening as at 46 through the wall of the mandrel 45 of the tool 25, thus communicating with the tubing-casing annulus 47 above the packer 27. The lower end of the wash pipe 44 projects through reduced bore 41 and opens into the interior of the screen therebelow. Seal means 48 seals between the wash pipe 44 and the screen as shown. This seal may be any suitable seal and may be carried by the screen (as shown) or on the wash pipe.

Mandrel 45 of the tool 29 has its lower portion telescoped into body 50, and its lower end is enlarged as at 52 and carries a seal at 53 as shown. It is readily seen that the mandrel 45 may be lifted a short distance before its enlarged lower end contacts shoulder 54 provided by the reduced upper portion 55 of bore 56 of body 50. This limits the upward travel of the mandrel. Downward movement of the mandrel is limited by its enlarged lower end engaging upwardly facing shoulder 58 provided by bore 56 being reduced as at 60. Thus, the mandrel and body are telescopically engaged for limited relative longitudinal movement. In FIG. 1, this telescope connection, or lost motion means, is clearly retracted, while in FIG. 2, it is shown to be extended. It is readily extended by merely lifting the tubing 26.

The body 50 of the tool 29 is reduced in diameter as at 70 providing a downwardly facing shoulder 72 which is engaged with shoulder 34 in the packer to limit downward movement of the tool 29 relative to the packer.

The reduced portion 70 of the tool body is disposed in the smooth bore 33 of the packer. This reduced portion 70 has lateral ports 75 near its lower end which, when the body is supported on packer shoulder 34, are located close to and communicate with ports 35 located in the wall of the packer just above the screen.

Seal means such as seal rings 77 and 78 seal between the body and the packer above and below the lateral openings 35 as shown. These seals (77 and 78) are preferably carried on the tool body although they could be carried by the packer.

In FIG. 1 the apparatus is positioned with the telescoped members (tool mandrel and body) in retracted position. In this position, gravel pack slurry, for instance, can be pumped from the surface downwards through the tubing 26, downward through the tool mandrel 45 and body 50 but exterior of the wash pipe 44, outward from the tool through the aligned lateral ports 75 and 35 of the tool and packer, respectively, and into the casing below the packer 27 to thus pack the casing 21 above the plug 24 and around the screen 28. The gravel is caused to accumulate thus as the liquids carrying the same flow through screen slits 38, flow upwardly in the screen, enter and pass through wash pipe 44, and are dumped into the tubing casing-annulus 47 above the packer for the return trip to the surface.

After sufficient gravel has been deposited in the casing below the packer, the excess gravel, such as in the slurry yet within the packer, the tool, and the tubing, is removed in a manner now to be described.

The tubing is lifted to extend the lost motion mechanism, that is, the telescopically engaged members, and to lift the lower end of the wash pipe 44 above the seal 48, as is clearly seen in FIG. 2. Cleanout fluids, such as water, for instance, are then pumped from the surface downwards through the tubing-casing annulus 47, into and through the wash pipe 44, and upward about the exterior of the wash pipe and through the packer, the tool 29, and the tubing 26 to the surface. After the excess slurry has been cleared from the well, it is generally preferable to disconnect the tool 29 from the packer, remove it from the well and run the tubing string back into the well with a production seal unit (not shown) attached to its lower end. This production seal unit would preferbly have means to locate on shoulder 34 in the packer and sealingly bridge across lateral openings 35. Thus, production fluids, oil and/or gas, would enter the casing through perforations 22, move through the gravel pack, enter the screen 28 through slits 38, and flow upwardly through the production seal unit (not shown) and the tubing to the surface.

It is readily seen that the apparatus illustrated in FIGS. 1 and 2 has means for establishing a first circuit for circulating fluids from the surface down the tubing and through the packer to the exterior of the screen, through the screen and from the interior of the screen, through the packer and return to the surface through the tubing-casing annulus, as indicated by the arrows in FIG. 1.

Similarly, it is seen that the apparatus of FIGS. 1 and 2 has means providing a second circuit, responsive to lifting the tubing relative to the packer, for circulating fluids from the surface down the annulus through the packer and return to the surface through the tubing.

It is also readily seen that in lifting the well tubing 26 from its FIG. 1 position to its FIG. 2 position, the body 50 of service seal unit tool 29 was not lifted. Thus, seals 77 and 78 which are carried on the tool body 50 and which seal above and below parts 35 of packer 27 were not moved and, so, were not damaged.

It is further understood that when the apparatus is in the position shown in FIG. 1, flow from the tubing-casing annulus may be closed off at the surface, generally by closing the casing wing valve (not shown), allowing fluid pressure to be increased in the well and making it possible to force treating fluids outwards through the casing perforations and into the producing formation to treat the same. However, this treating pressure will be applied in the casing, which has little or no external support at the earth's surface and can be readily damaged or ruptured. Such hazard is normally eliminated by providing a valve in the service seal unit tool which can be used to control return flow through the wash pipe by opening and closing the port 46 at its upper end in response to lifting and lowering the pipe string or tubing 26. Apparatus providing such a valve is shown in FIGS. 3A–5B.

Figure 3A:
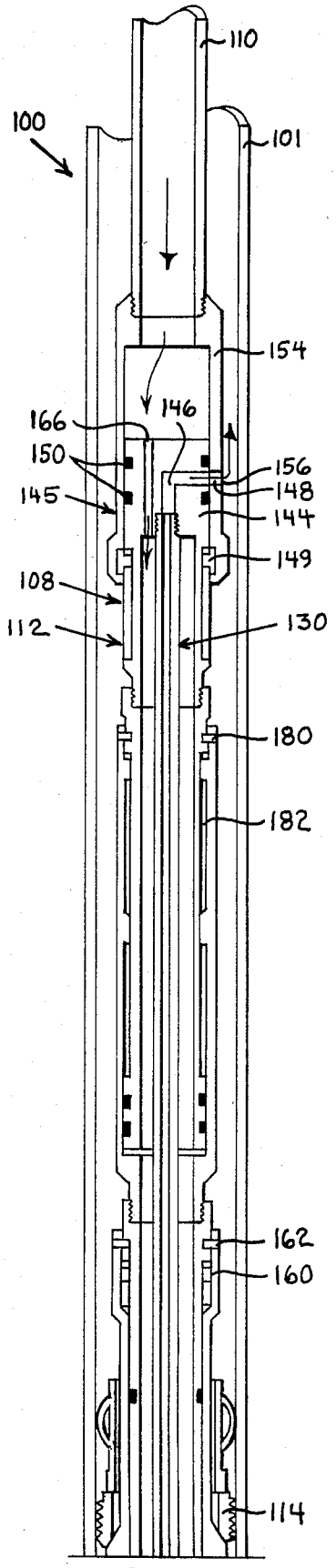
FIGS. 3A and 3B together constitute a schematical view similar to FIG. 1 but showing the apparatus in greater detail and showing fluids being circulated through the screen.
Figure 3B:
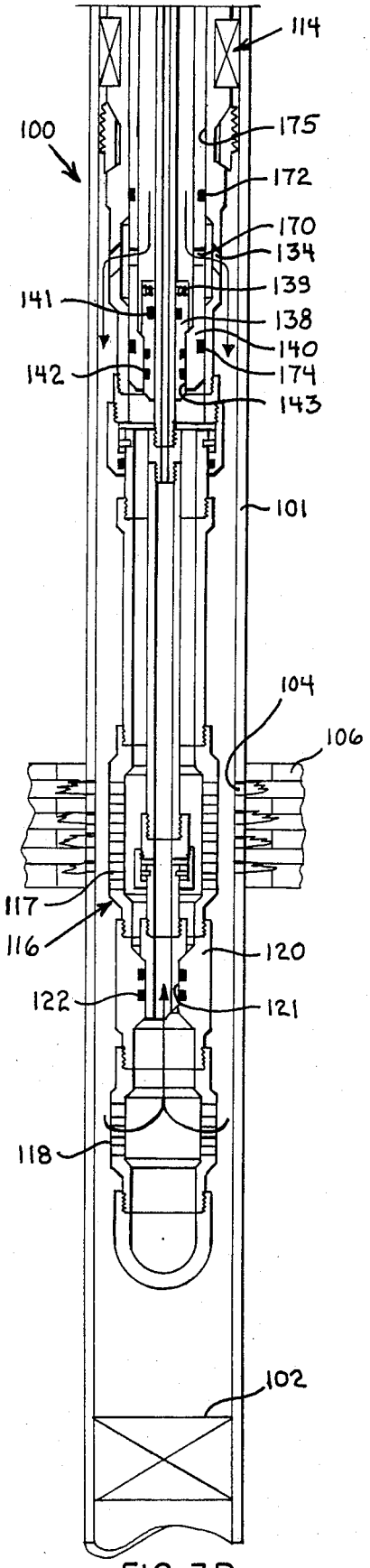

In FIGS. 3A and 3B, a well 100 is shown to have its casing 101 plugged as at 102 by suitable means and perforated as at 104 opposite a producing zone 106. Apparatus 108 of this invention attached together as shown is seen to be installed in the well 100, having been run thereinto via pipe string or tubing 110 which is still attached thereto. This apparatus comprises service seal unit tool 112, well packer 114, and well screen assembly 116.

The well packer 114 may be similar to that illustrated and described in U.S. Pat. No. 3,398,795 or 3,710,862 which are incorporated herein by reference, or it may preferably be an Otis Type GP Gravel Pack Packer available from Otis Engineering Corporation, Dallas, Texas, and illustrated at pages 70–76 in their catalog OEC 5120D entitled PRODUCTION PACKER EQUIPMENT AND SERVICES. The well screen 116 may be like that shown in the same catalog beginning at page 78.

The well packer 114 has been set in the casing at a level above the perforations 104, and the screen 116 suspended from the packer is disposed near the perforations as shown.

The apparatus of FIGS. 3A and 3B differs from that illustrated in FIGS. 1 and 2 in several respects. The screen assembly 116 is made up of a regular or main screen 117 and a telltale screen 118 with a packing nipple 120 therebetween. The polished bore 121 of the nipple is of rather restricted diameter as shown. The telltale screen may be somewhat shorter than the main screen. Also, the wash pipe of the service seal unit tool 112 passes through the main screen and opens into the telltale screen therebelow. Seals 122 in the packing nipple sealingly engage about the lower end of the wash pipe as shown. Above the main screen, but below the lateral ports 134 of the packer, a packing sleeve 138 is disposed about the wash pipe 130 and secured thereon as by set screws 139 in its shouldered position as shown and closes the annular space between the wash pipe and the body 140 of the service seal unit tool 112. It is noted that seals 141 seal between the sleeve and pipe while seals 142 seal between the sleeve and bore 143 of the body. Thus, flow cannot take place through the main screen at this time since both of its ends are sealed as just described.

Further, the upper end of the wash pipe 130 is attached to the cross flow head 144 of valve 145 and communicates with the lower end of an L-shaped flow passage 146 whose upper end opens outwardly through the side of the head as at 148. Seals 150 are carried by the head above and below side opening 148 and sealingly engage the inner wall of sleeve 154 which is attached to the lower end of tubing 110 and which telescopes over the cross flow head 144 as shown. Sleeve 154 has a lateral aperture 156 in its wall which communicates with side opening 148 and, therefore, the wash pipe 130 when the tubing is lifted to an upper position as seen in FIG. 3A. But when the tubing is lowered to a lower position seen in FIG. 4A, the aperture 156 of the sleeve cannot communicate with side opening 148. Thus, by lifting and lowering the tubing 110, the side opening 148 can be opened or closed and flow through the wash pipe permitted or prevented.

Bypass passage 166 passes vertically through the head 144 and communicates the bore of the sleeve 154 above the head with the region below the head but exterior of the wash pipe.

The valve is provided with travel limiting means 149 which locks and unlocks the valve 145 in the closed position, and this lock means is operated in a manner to be described (with respect to FIGS. 7A–7G, 8, and 9) by lifting and lowering the tubing.

The service seal unit tool is releasably connected to the packer by means including a pin and slot arrangement such as a J-slot mechanism, indicated by reference numeral 160, but also by shearable means such as shear pins 162.

In FIG. 3A and 3B, the tubing is shown lifted to a position in which valve 145 is open and in which there is established a first fluid flow path for circulating fluids through the well and apparatus as will now be described.

The arrows in FIGS. 3A and 3B indicate flow of fluids through the apparatus. It is seen that fluids from the surface flow down the tubing, into the sleeve 154, through bypass passage 166 of head 144, down about the exterior of wash pipe 130, outwards through ports 170 of the tool body and ports 134 of the packer into the casing below the packer and down to the perforations 104 and about the screen assembly 116.

It is readily seen that fluids flowing through aligned ports 170 and 134 in the tool 108 and packer 114, respectively, cannot migrate any appreciable distance between the tool and packer since seals 172 and 174 engaged therebetween provide a barrier for protecting the polished bore wall 175 of the packer from attack and damage by contact with hostile fluids such as acids, or the like fluids.

Fluid cannot return through the main screen 117 since the wash pipe bore does not at this time communicate therewith. Fluids may, however, flow inwardly through telltale screen 118 and move up through wash pipe 130 to the cross-flow head 144 where it empties through side opening 148 and sleeve port 156 into the tubing casing annulus to the surface to complete the circuit. Thus, well fluids may be displaced by such circulation, or acids, or other treating fluids may be brought into contact with the formation 106 through perforations 104, or gravel may be packed about the screen assembly, as desired.

Figure 4A:
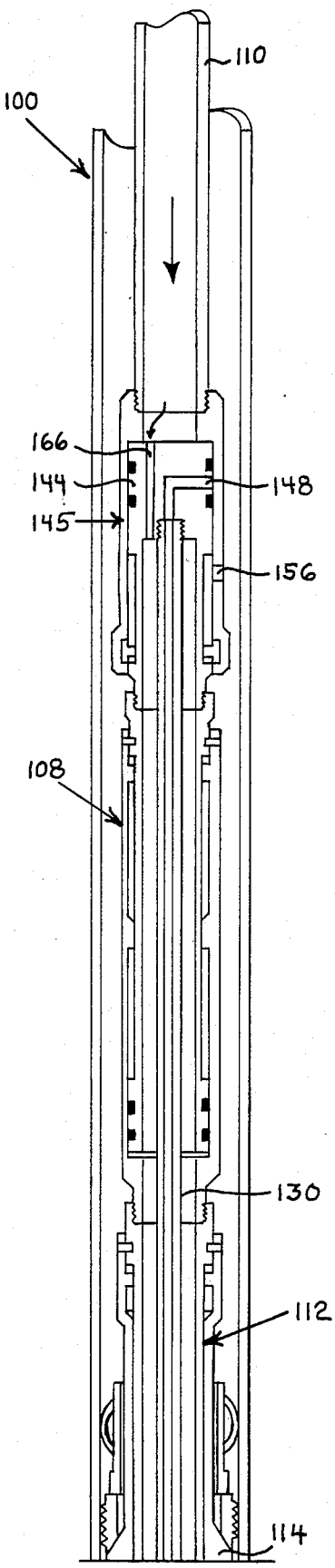
FIGS. 4A and 4B together constitute a schematical view similar to that of FIGS. 3A and 3B but showing the well and apparatus of FIGS. 3A and 3B with fluids being injected through the casing perforations into the surrounding earth formation.
Figure 4B:
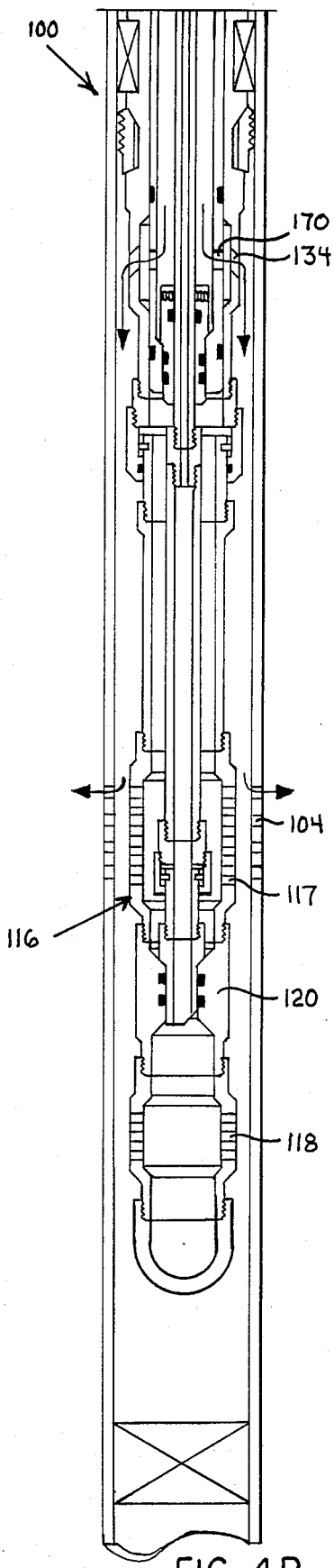

FIGS. 4A and 4B show the apparatus 108 of FIGS. 3A and 3B with the tubing 110 lowered and the valve 145 closed so that no flow can take place through the wash pipe 130. Arrows indicate that fluids from the surface now move down the tubing, through bypass passage 166 of the head 144, down about the exterior of the wash pipe through the service seal unit tool 112 and packer 114 and outward through ports 170 and 134 of the tool 112 and packer 114 and down to the perforations 104, then through the perforations and into the formation (not shown) exterior of the casing.

Since, at the end of the treatment of the formation with treating medium, some of the treating medium will remain in the tubing and the apparatus, such excess medium should be removed from the well because, for instance, hostile fluids such as acid will attack and damage the well conduits and the apparatus if it remains in contact therewith for an extended period of time. Removal of this excess treating medium is accomplished as illustrated in FIGS. 5A and 5B.

Figure 5A:
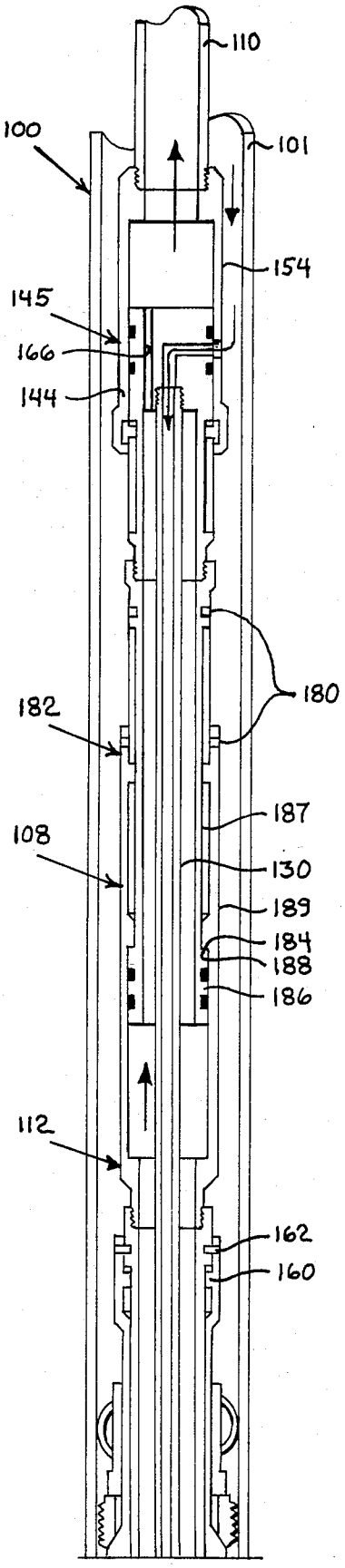
FIGS. 5A and 5B together constitute a schematical view similar to that of FIGS. 3A and 3B but showing cleanout fluids being circulated through the apparatus in a reverse pattern to remove excess treating medium from the well.
Figure 5B:
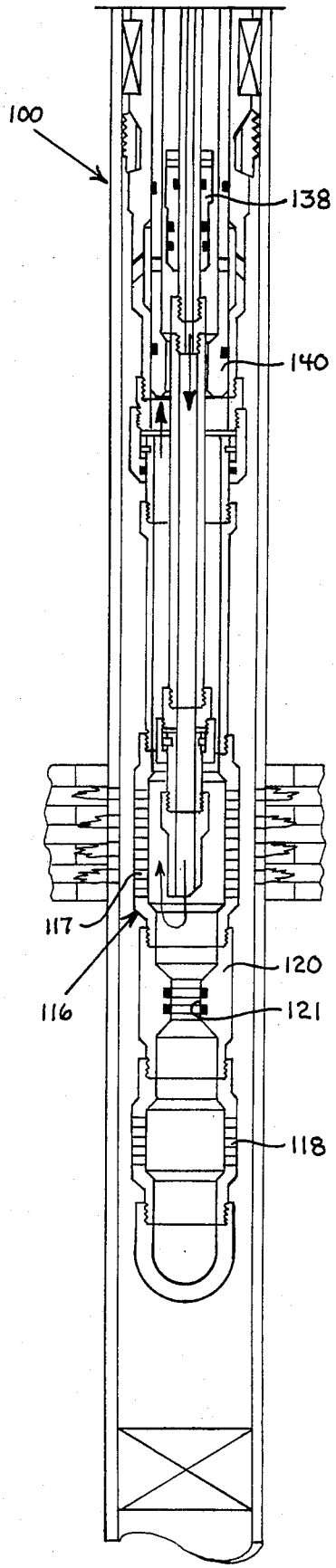

FIGS. 5A and 5B show the apparatus 108 of FIGS. 3A and 3B in position for reverse circulating cleanout fluids through the tubing and apparatus to remove excess treating medium. The tubing 110 has been raised to open the valve 145 to permit flow through the wash pipe 130 as it was in FIG. 1, but in addition the tubing has been further lifted, shearing the shear pins 180 which to now have secured the telescoping joint 182 in retracted position as clearly shown in FIGS. 3A and 4A. With the tubing in this higher position, the valve 145 is open, and, in addition, the wash pipe 130 has been lifted to a new and higher position relative to the packer and screen as a result of extending the telescoping joint. Thus, a second fluid flow path has been established for circulating fluids through the well and apparatus, as will be more fully explained.

It is noted that lifting of the tubing and extension of the telescoping joint, as just explained, was accomplished without moving the seals 172 and 174 in the packer bore 175, thus, they continue to protect the packer bore from hostile fluids.

Shearing of telescoping joint pins 180 allows the tubing 110 to be lifted until the upwardly facing shoulder 184 on the head 186 of the telescoping joint inner member 187 engages downwardly facing shoulder 188 of the joint's outer member 189. With the tubing lifted to this new and higher level, with the valve 145 open, and with the telescoping joint 182 extended, the wash pipe will be suspended as shown in FIGS. 5A and 5B. The lower end of the wash pipe will have been lifted clear of the seals 122 in the restricted bore 121 of packing nipple 120, and the packing sleeve 138, attached to the wash pipe a spaced distance from the upper end of the wash pipe, will have been lifted out of the restricted bore 143 at the lower end of the body 140 of the service seal unit tool 112. Cleanout fluids may then be reverse circulated as indicated by the arrows to clean out and carry away the excess treating medium to the surface for disposal. The arrows indicate that fluids are circulated from the surface down the tubing-casing annulus, through the open valve 145 and through the full length of the wash pipe 130 to the lower end of main screen 117, then up about the exterior of the wash pipe to the cross-flow head 144 and through vertical bypass passage 166 thereof into the sleeve 154 above the head, and from there, upward through the tubing 110 to the surface.

After treating of the well has been carried out, further lifting of the tubing results in the shearing of shear pins 162 and release of the service seal unit tool 112 from the well packer, and the pipe string and the service seal unit tool are removed from the well 100 leaving the packer 114 and screen assembly 116 in place in the well.

Figure 6:
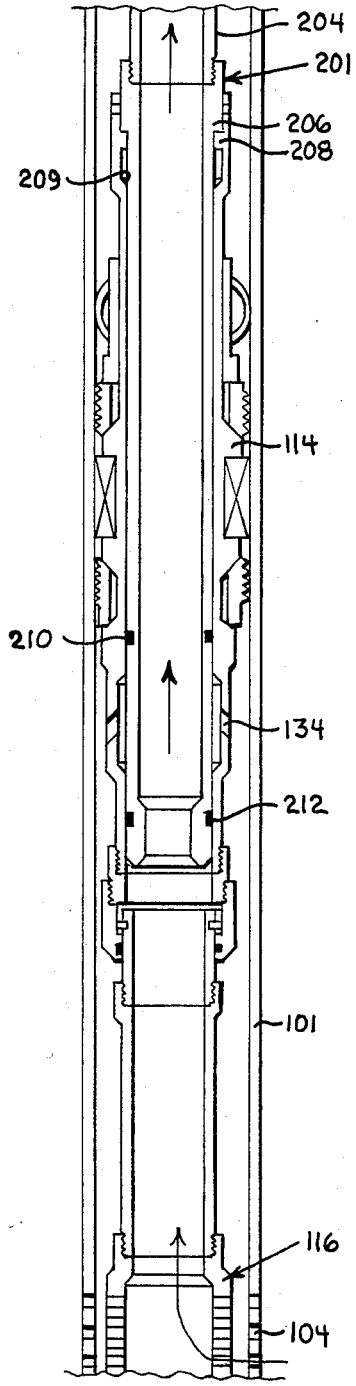
FIG. 6 is a fragmentary schematical view similar to that of FIGS. 3A and 3B showing the well of FIGS. 3A and 3B being produced.

If the well is now ready to be produced, as would generally be the case, a production seal nipple 201 is attached to the lower end of a production tubing string 204 and installed in the well packer 114 as shown in FIG. 6.

The production seal unit 201 is provided with locator means as at 206 which may or may not latch to the J-latch pins 208 in the upper end of the packer or may provide only a shoulder for engaging an opposing shoulder such as shoulder 209 in the upper end of the packer. In any case, the locator sub limits downward movement of the seal nipple in the packer to locate the seal nipple 201 therein so that its seals 210 and 212 sealingly engage the inner wall of the packer above and below packer ports 134. The seals 210 and 212 thus will not permit flow to enter the packer through ports 134.

Well fluids now may enter the casing 101 through perforations 104, pass into the screen assembly 116 and flow upwardly through the screen to the lower end of the seal nipple 201. From there, fluids may flow upwardly through the seal nipple and the production tubing 204 to the surface.

The service seal unit tool of this invention is shown in detail in FIGS. 7A–7G, 8, and 9.

In FIGS. 7A–7G, 8, and 9, the service seal unit tool is indicated generally by the reference numeral 300. The service seal unit tool comprises a valve such as sleeve valve 310, a tubular telescoping joint 312, and a tubular body or mandrel 314, connected together in coaxial relation as shown, and a flow tube or wash pipe 316 suspended therein from the valve 310 as will soon be described. The wash pipe 316 extends below the lower end of the mandrel 314 generally several feet.

The valve 310 may be like that illustrated and described in U.S. Pat. Nos. 3,710,862 or 4,180,132 mentioned above and incorporated herein by reference for all purposes.

The body assembly 314 (FIGS. 7E–7G) is tubular and is preferably formed of several components for economic reasons. At its upper end is the J-slot mandrel 320 having means such as thread 321 for connection to the upper portions of the tool 300. The mandrel 320 is enlarged as at 322 and is formed with J-slot means (taught in U.S. Pat. No. 3,398,795) such as J-slots 323 for engaging the J-pins of a packer (not shown) such as the packer 114 described hereinabove with respect to FIGS. 3A–6. The J-slots, upon engaging the J-pins in the packer will automatically rotate the mandrel so that the mandrel, once engaged fully, cannot be lifted free of the packer unless the mandrel is rotated in the opposite direction as it is lifted. In this case, however, the mandrel is engaged in the packer before they are lowered into the well together. Since it is important that the body 314 remain engaged with the packer until treating of the well has been completed, a shear sleeve 324 is disposed about the mandrel as shown, and its internal downwardly facing shoulder 325 is engageable with the upwardly facing shoulder 326 at the upper end of enlargement 322 of the mandrel. Near its lower end, the shear sleeve 324 is provided with a plurality of shear pin holes 327 which are engageable by a desired number of shear pins such as shear pin 328 which may be disposed in similar shear pin holes in the packer. With the J-slot mandrel attached to the packer by the shear sleeve 324 being thus pinned to the packer, the mandrel cannot be disengaged from the packer even though the J-slot mechanism be unjayed. Of course if, while the J-slot mechanism is unjayed, an upward pull is applied to the mandrel with a force exceeding the shear force of the shear pins 328, the pins 328 will shear and will allow the mandrel to be lifted free of the packer. If an upward pull is applied to the mandrel while the J-slot mechanism is engaged or jayed, then the hook portion 323*a* will engage the J-pins and no shearing force will be applied to the shear pins 328; the entire force will be borne by the J-slot and pin. At such time, the downwardly facing shoulder 325 of the shear sleeve will be very slightly above the upwardly facing shoulder 326 of the J-slot mandrel.

The J-slot mandrel 314 is reduced in diameter, threaded and coupled by means of threaded coupling 330 to the upper end of spacer or pup joint 332 whose lower end is threadedly attached to the upper end of the upper packing mandrel 334 having its outer diameter reduced as at 335 to accommodate external seal rings 336. The lower end of packing mandrel 336 is threaded into spacer or extension 340 whose upper end retains seals 336 in place and whose lower end is connected by threaded coupling 330*a*, which may be identical to coupling 330; to the upper end of ported tube 344 having a plurality of lateral openings such as slots 345 formed in its wall near its lower end, as shown.

The lower end of the ported tube 344 is threadedly connected as at 348 to the upper end of the lower packing mandrel 350 having its outer diameter reduced as at 351 to accommodate seal rings 336*a* (which may be exactly like the seal rings 336 mounted on upper packing mandrel 334) which are retained on the packing mandrel by nut 352 threaded thereon as at 351*a* and tightened against shoulder 353. The seals 336 and 336*a* of the upper and lower packing mandrels 334 and 350 engage the inner wall of the packer bore, when the tool 300 is installed in a packer (not shown), and these seals 336 and 336*a* which are mounted on the body assembly 314 above and below the lateral openings or slots 345 will sealingly engage the packer bore above and below the lateral ports of the packer. Thus, fluids may flow from the interior of the body 314 to the exterior of the packer through aligned slots 345 and lateral ports of the body 314 and the packer (not shown), respectively.

Attached directly to the upper end of the tool body 314 as by thread 321 is the lost motion means in the form of telescoping joint 312 as shown. The bottom sub 355, which has its lower end attached to the upper end of body 314, is enlarged as at 356 and has its upper end reduced in outer diameter and threaded as at 357 for attachment to the lower end of housing 358 comprised of plunger housing 360 and plunger barrel 370. This connection is secured by set screw 356*a* and is made pressure tight by seal ring 357*a* disposed in a suitable seal recess as shown.

Plunger housing 360 of the telescoping joint 312 has a smooth bore 362. Its upper end is threaded as at 364 and connected to the lower end of connector sub 365, and this connection is made secure by set screws 364*a*. Connector sub 365 is enlarged as at 366. Its bore 367 is enlarged at its upper end and threaded as at 368 and is attached to the lower end of plunger barrel 370, and this connection is secured as by set screws 371.

The plunger barrel 370 is provided with an inwardly projecting lug 372 welded as at 373 in a suitable opening in the wall of the barrel near its upper end. Above the lug 372 and just below the upper end of the barrel is a plurality of threaded apertures circumferentially spaced about the barrel, as shown, for a purpose to be explained later.

A tubular plunger 380 comprised of the upper plunger member 381, intermediate plunger member 382 and plunger packing mandrel 383 threaded together as shown is slidably telescopingly engaged in the housing 358.

The plunger packing mandrel 383 is slidably mounted in the smooth bore 362 of the plunger housing 360. This packing mandrel is reduced as at 385 and carries a pair of seal rings 386 which seal between the plunger packing mandrel 383 and the plunger housing 360. A nut 388 is threaded onto the lower end of the plunger packing mandrel to retain the seal rings 386 thereon.

The upper end of the plunger packing mandrel 383 is internally threaded as at 389 to receive the lower threaded end of intermediate plunger member 382. The upper end of the intermediate plunger member 382 is threadedly connected as at 390 to the lower end of the upper plunger member 381.

Upper plunger member 381 is somewhat larger in outer diameter than is the lower plunger member 382, and since its internal diameter is substantially the same, it has a much thicker wall. Formed in the exterior surface of the upper plunger member is a straight longitudinal groove or slot 392 in which is engaged the inner projecting portion of lug 372 welded into the wall of the barrel 370 as previously described. The engagement of the lug 372 in the slot 392 prevents relative rotational movement between the plunger and the outer barrel and housing, thus enabling the telescoping joint to transmit torque which is required for such things as operating the J-slot mechanism connecting the tool 300 to the well packer (not shown).

The slot 392 extends from near the upper end of the upper plunger member to the extreme lower end thereof. Thus, the plunger 381, 382, 383 is reciprocable in the barrel-housing 370, 360, its extension being limited by engagement of the upper end 394 of plunger packing mandrel 383 with the lower end face 395 of sub 365. Retraction of the telescoping joint is limited by engagement of the lower beveled end surface 396 of the upper plunger member 381 with the upwardly facing inclined shoulder 397 formed in connector sub 365 just below internal thread 368.

Figure 7A:
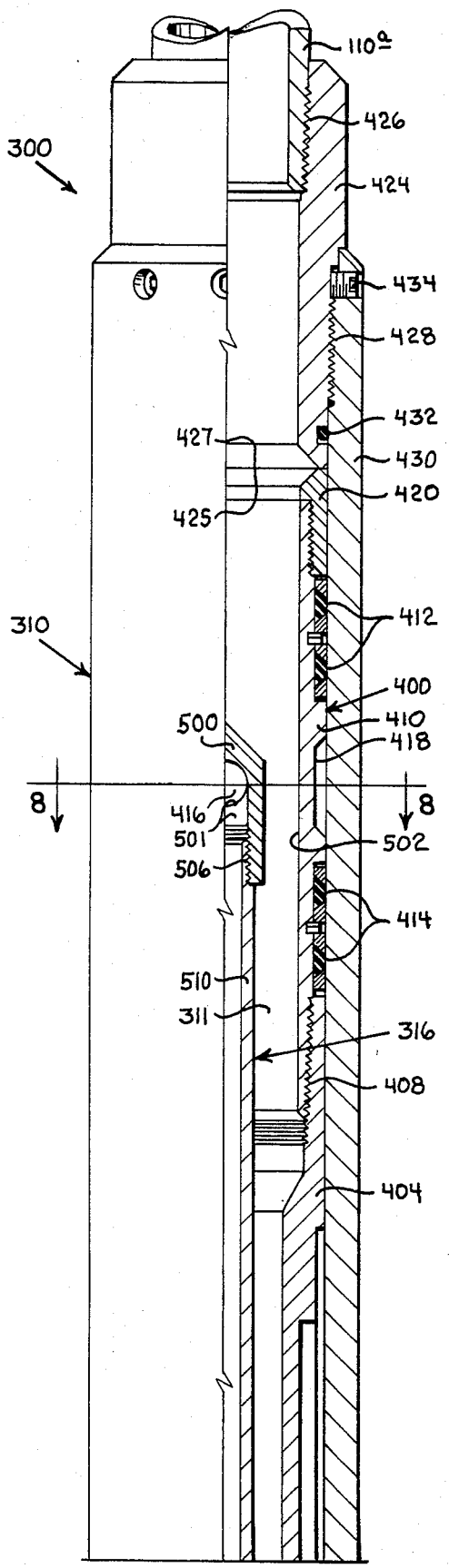
FIGS. 7A–7G taken together constitute a longitudinal view, partly in section and partly in elevation, with some parts broken away, showing the service seal unit tool of this invention.
Figure 7B:
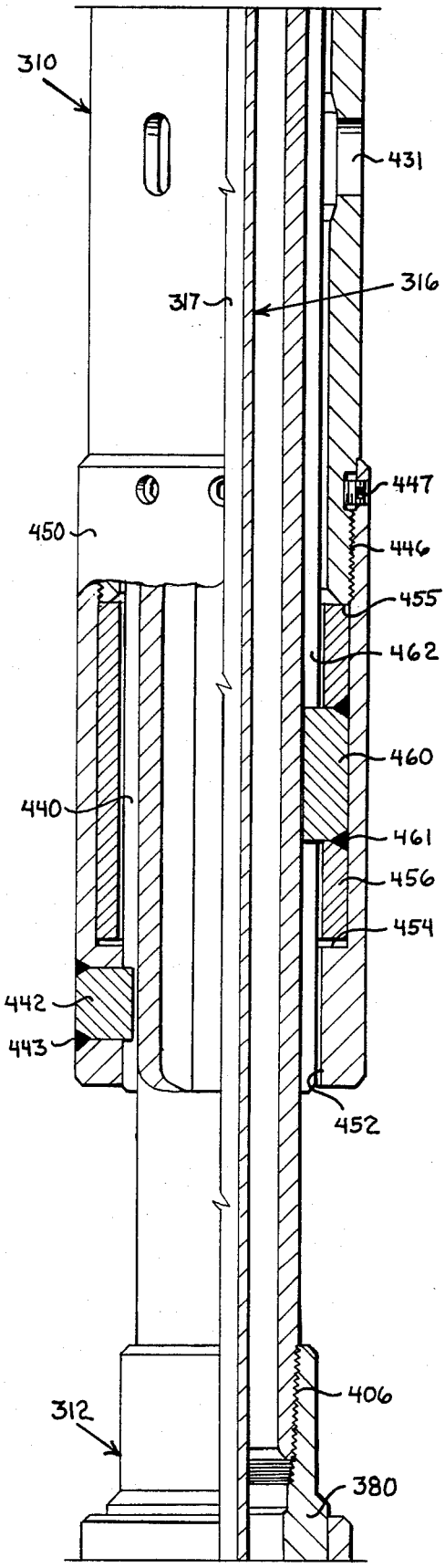
Figure 7C:
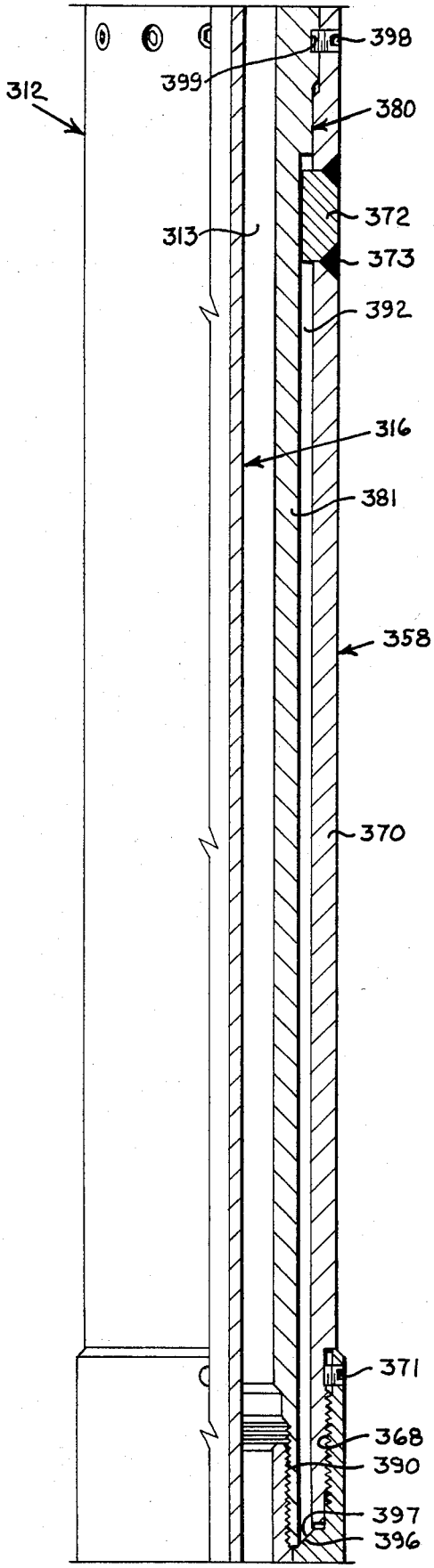

Telescoping joint 312 is initially releasably secured in retracted position as shown in FIGS. 7C by frangible means, such as one or a plurality of shear screws 398 screwed into suitably threaded apertures circumferentially spaced about the barrel 370 preferably just below its upper end, the inner end portions of these shear screws engaging in suitable recesses, such as recess 399 formed in the outer surface of the upper plunger member 381 as shown.

It is preferred that the combined shear value of the shear pins 328 securing the tool body 300 to the upper end of the packer (not shown) exceeds the combined shear value of the shear screws 398 which secure the telescoping joint in its retracted position. This is true because the shear screws 398 must be sheared, without shearing the pins 328, to make possible the extending of the telescoping joint in order to remove excess treating fluids such as acid from the well, and this may need to be done long before the well treating operation is concluded. The very last step in the entire treating operation is to unjay the J-slot and pin connection and lift the pipe string or tubing 110*a*, shear the shear screws 328, and retrieve the tubing and tool 300 from the well. Thus, the shear pins 328 are the very last shearable members to be sheared. If, however, the J-slot and pin are left engaged, the pins 328 cannot be sheared since this load will be borne by the J-slot connection.

The valve 310 attached to the upper end of telescoping joint 312 has a cross flow head assembly 400 comprising an indexing mandrel 404 threadedly connected as at 406 to the upper end of the telescoping joint 312. The indexing mandrel is internally threaded as at 408 and attached to the lower end of cross flow head member 410 which is reduced in outside diameter at its opposite ends and fitted with a pair of seal sets 412 and 414 which are disposed above and below a lateral passage or cross flow port 416 formed in the head wall on a level with external annular recess 418. End cap 420 retains the seal set 412 in place on the cross flow head member and also functions to limit the down stroke of the valve in a manner soon to be made clear.

The top sub 424 of the valve connects the valve 310 to the pipe string or tubing 110*a*. The top sub is internally threaded as at 426 for attachment of the tubing and is externally threaded at its lower end as at 428 for attachment of the valve sleeve 430, and this connection is made fluid tight by seal ring 432 disposed in a suitable recess formed about the lower end of the top sub 424 as shown. This connection also is preferably made secure by one or more set screws 434 disposed in suitably threaded apertures circumferentially spaced about the upper end of valve sleeve 430 with their inner ends engaged in suitable recesses formed in the outer surface of the top sub 424 as shown.

Valve sleeve 430 telescopes over and is longitudinally slidable relative to the plunger cross flow head 400 and indexing mandrel 404. Downward movement of the valve sleeve relative to the cross flow head is limited by the engagement of the lower end 425 of top sub 424 with the upper end 427 of cap 420 of the cross flow head 400, as is shown in FIG. 7A.

The indexing mandrel 404 is formed with two widely differing slots in its exterior surface. One is a straight longitudinal slot or keyway 440 which is engaged at all times by an inwardly projecting key 442 secured as by welding as at 443 into a suitable aperture in the wall of indexing sleeve 450 threadedly attached as by thread 446 to the lower end of valve sleeve 430. This connection is secured by set screws 447. This indexing sleeve 450 is reduced in inside diameter as at 452 providing an upwardly facing abrupt shoulder 454 upon which is supported a loose-fitting free turning indexing ring 456 having an inwardly projecting control pin 460 secured as by welding as at 461 in a suitable aperture in the wall thereof. Indexing ring 456 fits loosely about the indexing mandrel and inside the indexing sleeve, as well as being loosely confined between upwardly facing shoulder 454 of the indexing sleeve and the lower end 455 of the valve sleeve 430 and will turn freely but only as permitted by indexing slot 462.

The inwardly projecting control pin or indexing pin 460 has its inward end engaged in control slot or indexing slot 462 formed in the exterior surface of the indexing mandrel. The indexing slot 462 and the indexing pin 460, as well as the keyway 440 and key 442, may be exactly like that illustrated and described in U.S. Pat. No. 3,710,862 mentioned hereinabove. While key 442 carried by the indexing sleeve 450 coacts with keyway 440 in the indexing mandrel to prevent relative rotational movement between the indexing mandrel and the valve sleeve, the indexing pin 460 coacts With the indexing slot 462 to control the limit of extension of the valve 310. More explicitly, the indexing slot 462 is so formed that it provides for both short and long strokes of the valve 310 as the valve sleeve 430 is moved longitudinally relative to the indexing mandrel to index the valve to open and closed positions responsive to lifting and lowering the pipe string or tubing as will be explained. The key and keyway 442, 440 enable the valve 310 to transmit torque as needed.

Figure 9:
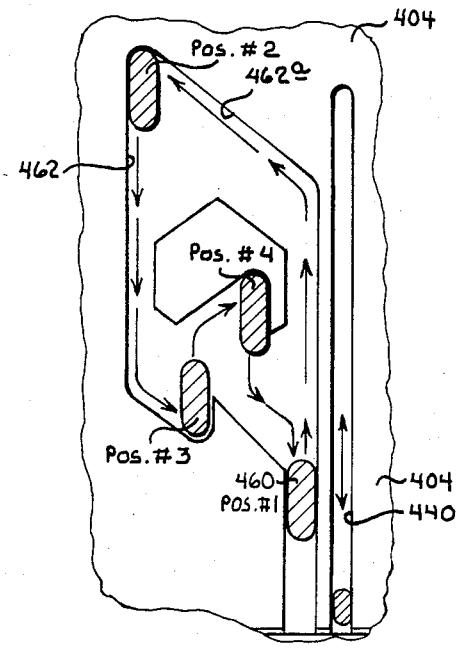
FIG. 9 is a fragmentary view showing the indexing slot mechanism which controls the valve in the service seal unit tool of FIGS. 7A–7G.

In FIG. 9, the indexing slot 462 and the keyway 440, formed in the exterior surface of the indexing mandrel, are more clearly shown. It is understood that the indexing mandrel 404 remains unmoved while the valve 310 is operated by lifting and lowering the tubing 110*a* and the valve sleeve 430 attached thereto, and that the indexing pin 460 being fixed to the indexing ring 456 moves up and down therewith relative to the indexing mandrel as does the key 42 fixedly attached to the indexing sleeve 450.

Thus, it can readily be seen in FIG. 9 that the key 442 is engaged in the keyway 440 and will prevent relative rotational movement between the indexing mandrel 404 and the indexing sleeve as the valve 310 is operated, the key 442 moving up and down in the keyway 440 as the valve sleeve 430 is lifted and lowered.

At the same time that the tubing and valve sleeve 430 are lifted and lowered, the indexing pin 460 follows the indexing slot 462 as shown by the arrows. Beginning with the telescoping members of the valve fully retracted to fully closed position, the indexing pin will be in its lowermost position near the lower end of the indexing slot 462, this position being labeled "Pos. #1" as seen in FIG. 9. When the tubing is lifted, the indexing pin 460 will move to the upper limit of the indexing slot, labeled "Pos. #2". It is understood that as the indexing pin moves upward in the indexing slot and engages the inclined portion 462*a* thereof, this inclined wall will guide the indexing pin to the upper end of the slot marked "Pos. #2" even though the indexing sleeve is non-rotational by virtue of key 442 in keyway 440, this lateral movement towards the left being permitted by rotational movement of loose-fitting indexing ring 456 rotatably mounted within the indexing sleeve 450. In this position (Pos. #2) of the pin, the valve 310 is fully open. When the tubing is then lowered, the pin 460 moves from position "Pos. #2" to postition "Pos. #3" in which position the valve is again fully closed. When the tubing is lifted again, the pin will move to position "Pos. #4", but this position falls far short of reaching the height of position "Pos. #2", and the valve remains fully closed. Upon lowering the tubing again, the pin 460 then moves back to its initial position, "Pos. #1". Thus, with the indexing slot 462 formed as shown, the valve may be opened and closed repeatedly, being opened every second time that the tubing is lifted. Thus, the indexing slot and pin arrangement provides alternate long and short strokes to positively index the valve 310 to its open and closed positions. Therefore, the operator can be certain whether the valve 310 is open or closed by observing how high the tubing can be lifted. Normally a mark is placed on the tubing, and this mark is noted with respect to a fixed reference point, usually the top of the rotary table or the rig floor, for instance, in order to differentiate between the long and short strokes of valve 310 and thus readily note whether the valve is open or closed at a given time.

It should be understood that the indexing slot could be formed to provide any desired combination of long and short strokes. For instance, by repeating positions #3 and 4 in its pattern, two or more short strokes could be provided for every long stroke, and vice versa.

The valve 310 is open when its sleeve 430 is lifted to the top of its long stroke. The sleeve 430 is provided with a lateral window or through slot 431 which, when the sleeve is down as seen in FIGS. 7A and 7B, is located well below seal set 414 carried on the cross flow head 400. Thus, slot 431 cannot communicate with cross flow port 416, located above seal set 414. When, however, sleeve 430 is lifted to the top of its long stroke, its slot or window 431 will be located between seal sets 412 and 414 and aligned with cross flow port 416. In this position, the valve is open and flow may take place in either direction through the aligned ports 431 and 416.

Figure 8:
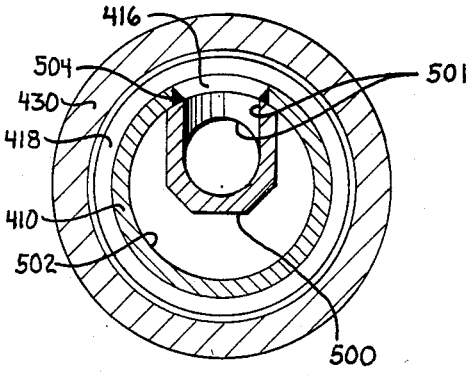
FIG. 8 is a cross-sectional view taken along line 8—8 of FIG. 7A.

In FIGS. 7A and 8, it is seen that the cross flow head member 410 is provided with means therein connected to the inward side of cross flow port 416. More explicitly, an elbow 500 having an L-shaped passage 501 therethrough is disposed in the bore 502 of the cross flow head member 410 and is welded thereto as at 504 so that one end of L-shaped passage 501 is in full register with cross flow port 416. The L-shaped passage 501 is internally threaded at its lower end as at 506, and the upper end of the flow tube or wash pipe 316 is threadedly connected to the elbow 500 thereat.

The wash pipe 316 comprises several tubular members connected together in coaxial relation as will now be described.

A length of small diameter pipe 510 has its upper end threadedly connected to the lower end of elbow 500 as shown. Threaded onto the lower end of pipe 510 is a coupling 512 to the lower end of which is connected another pipe section 510*a*. It is understood that if pipe 510 has sufficient length, coupling 512 and pipe 510*a* will not be needed. In either case, the small diameter pipe will extend to a point a few feet, for example, below the lower seal rings 336*a* on the lower packing mandrel 350.

The lower end of pipe 510*a* is threaded and a suitable length of larger pipe such as pipe 514 is attached thereto by threaded adapter 516 as shown.

A swivel shear sub or safety joint 520 is threaded to the lower end of pipe 514, and from this safety joint, a very short length of pipe such as pipe 522 is suspended. Finally, a stem or locator sub 524 is threaded to the lower end of pipe 522.

The safety joint 520 includes a housing 530 attached to the lower end of pipe 514 via threaded adapter 531 as shown. The bore of the housing 530 is reduced as at 532 to provide an upwardly facing shoulder 533 which supports shearable means 534 disposed in a suitable external annular groove formed near the upper end of pipe 522. A suitable seal such as o-ring 535 seals between the housing 530 and the pipe 522 as shown. The shearable means 534, for instance, may be in any suitable form such as a spiral lock ring or could be one or more shear pins 538 disposed in radially directed holes or recesses, their outer ends either being supported on the shoulder 533 or in apertures of a ring such as ring 536 supported on the shoulder 533. In any case, the shearable means should have a shear value somewhat less than the tensile strength of the pipes 510, 510*a*, 514, or their connections. This is because the locator sub at the lower end of the wash pipe is the member most likely to become fouled in treating operations, especially in gravel packing operations, and when it does become fouled, an upward pull on the wash pipe 316 of sufficient magnitude will cause the shearable means 533 to fail in shear, resulting in the safety joint 520 parting, and allowing the tool 300 thereabove to be removed from the well without the locator sub 524 and the pipe 522 attached thereto.

The locator sub 524 has its lower portion reduced in outside diameter as at 542 providing a downwardly facing inclined stop shoulder 540 which is engageable with an opposing shoulder in the packing nipple of a screen (not shown). The outer surface 542 of the reduced diameter portion of the sub is smooth, providing a suitable seal surface which is engageable by seals carried in a screen assembly (not shown).

It will be noticed that the lower packing mandrel 350 has its bore 353 reduced as at 354 providing upwardly facing shoulder 354*a*. Also, it will be noticed that a packing sleeve 550 surrounds the small diameter portion 510*a* of the wash pipe 316 within the lower portion of tool body 314, that is, adjacent the lower packing mandrel 350. The packing sleeve 550 is provided with one or a plurality of set screws 552 for securing the packing sleeve 550 on the pipe 510*a*. The position of the packing sleeve on the wash pipe is therefore adjustable.

The packing sleeve 550 is positioned on the wash pipe by moving it downward thereon until its external stop shoulder 554 engages the upwardly facing stop shoulder 354*a* in the lower packing mandrel. In this position, the seal rings 556 on the packing sleeve sealingly engage in the smooth bore 354 of the lower packing mandrel to prevent leakage of fluids therebetween. The set screws 552 disposed in suitably threaded apertures are then tightened to secure the packing sleeve on the wash pipe. The screws 552 are accessible with a suitable wrench or screwdriver inserted through slots 345 of slotted mandrel 344. Leakage between the packing sleeve 550 and the wash pipe is prevented by seal rings such as the seal rings 558 carried in suitable internal annular recesses in the packing sleeve as shown.

In using the service seal unit tool 300 and the remainder of the apparatus with which it is meant to function, it must be attached to a packer/screen combination and lowered into a well on a string of pipe. The packer may be any suitable gravel pack packer such as packer 114 of FIGS. 3A–6, or such as the Otis Type GP Gravel Pack Packer previously mentioned as being available from Otis Engineering Corporation, Dallas, Texas. The screen assembly may be any suitable screen assembly such as that indicated by the reference numeral 116 in FIGS. 3A–6, or may be made up of suitable components available from Howard Smith Screen Company, Houston, Texas, or from Otis Engineering Corporation, Dallas, Texas.

Prior to installing the apparatus in the well, the tool 300 is installed in the packer/screen combination, the J-slot is engaged with the J-pin of the packer, and pins such as shear pins 328 are installed in the aligned shear pin holes 327 of the tool and the packer, thus securing the tool to the packer. The locator sub 524 is seated in the packing nipple of the screen assembly, and the packing sleeve 550 is seated and its screws 552 are tightened to secure the packing sleeve 550 in position on the wash pipe 316. The telescoping joint 312 is secured in its retracted position by shear screws 398. These shear screws preferably have a total shear value somewhat less than the total shear value of the shear pins 328 which secure the tool to the packer for they must shear at the proper time without shearing pins 328. The tool 300 is connected to the lower end of the pipe string to be used in performing the well treating operation using this apparatus. This pipe string may be any suitable handling string or a string of well tubing, just so it possesses the required physical properties and is fluid tight and pressure competent.

The apparatus is lowered into the well to a depth where the screen assembly will be suspended opposite the casing perforations. The pipe string or tubing is then manipulated in the well-known manner to set the packer above the perforations by locking it in the casing and sealing the annulus between the packer and the casing, as shown in FIGS. 3A–6.

After setting and testing the packer, the tubing is lifted to open the valve 310 at the upper end of the service seal unit tool 300 and establish a first fluid flow circuit. Fluids such as water, oil, diesel fuel, or the like, may now be circulated down the tubing, through the main flow passage 311 of the valve 310, the main passage 313 of the telescoping joint 312, the main passage 315 of the tool body 314, and outward through the lateral slots 345 into the annulus between the screen and the well casing, then inward through the telltale screen, upward out of the telltale screen and into and through the bore 317 of the wash pipe 316, to exit through aligned lateral ports 416 and slots 431 of the valve, into the tubing-casing annulus and therethrough to the surface.

Since the wash pipe sealingly engages the main screen, both the upper and the lower end, flow cannot take place through the main screen, but through the telltale screen only, at this time.

Fluids are thus circulated through the apparatus to displace the well fluids from the well and to prepare the well for treatment to follow. If this treatment is to include acidizing followed by gravel packing, for instance, a plenteous quantity of acid may be pumped into the well and spotted in position to be forced outwards through the casing perforations and into the surrounding production zone in the well-known manner.

To force the acid into the formation and to protect the well casing, above the packer, from the high pressures which may be required, the tubing is lowered to close valve 310 by placing its lateral slots 431 below seals 414. Closing of valve 310 interrupts this first fluid flow circuit previously established by closing off outflow from the wash pipe 316. Pressure may now be increased in the tubing as additional fluids are injected thereinto to force the acid into the production formation.

After the pumping of acid into the formation has been completed, the tubing is lifted to open valve 310 to reestablish the first fluid flow circuit, but this time fluids are pumped through the well and apparatus in the reverse direction to rid the well of excess acid and to prepare the well for gravel packing to follow.

It is to be noted that reverse circulation is utilized to remove excess treating media from the well because, in this manner, the media may be cleared from the well quicker and with less volume of cleanout fluids since the capacity of the tubing is much less than the capacity of the annulus surrounding it, and the flow velocity is, therefore, greater in the tubing and will more dependably lift solids such as gravel which may need to be removed from the well.

In the gravel packing operation, gravel (or coarse sand) is mixed with a liquid to form a slurry. The tubing is lifted to open valve 310 and establish the first fluid flow circuit as before, then the slurry is introduced into the upper end of the tubing and pumped from the surface to the exterior of the screen below the packer. The gravel is moved down the tubing, through the packer, and out through the packer ports into the annulus surrounding the screen as was the acid. There, the gravel is deposited to make the pack. This gravel literally fills the casing below and around the screen as the slurry arrives in the area and the liquids from the slurry filter through the telltale screen and move up toward the surface. The level of the pack builds from the bottom upwards, and when it begins to cover the telltale screen, the fluids from the slurry find it increasingly more difficult to enter the telltale screen because of the increasing resistance being created by the advancing pack. Thus, pump pressure at the surface increases as does pressure applied to the face of the formation. This added pressure forces some of the gravel through the casing perforations and packs the perforations in the formation and any other crevices or cavities that it can get into and forms a porous propping arch or structure for supporting the formation against breakdown or collapse and thus prevents sand or solids from the formation from entering the well bore. After the gravel has been deposited to a sufficient level, usually well above the main screen and probably to a level near the packer ports, the excess gravel must be removed from the well without disturbing the gravel pack.

Figure 7D:
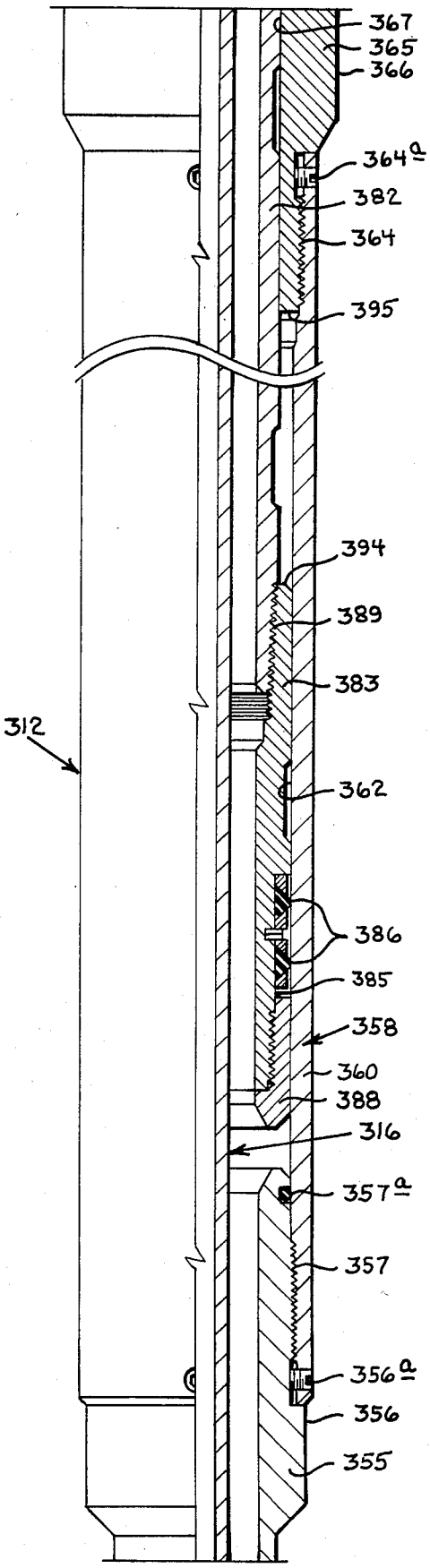
Figure 7E:
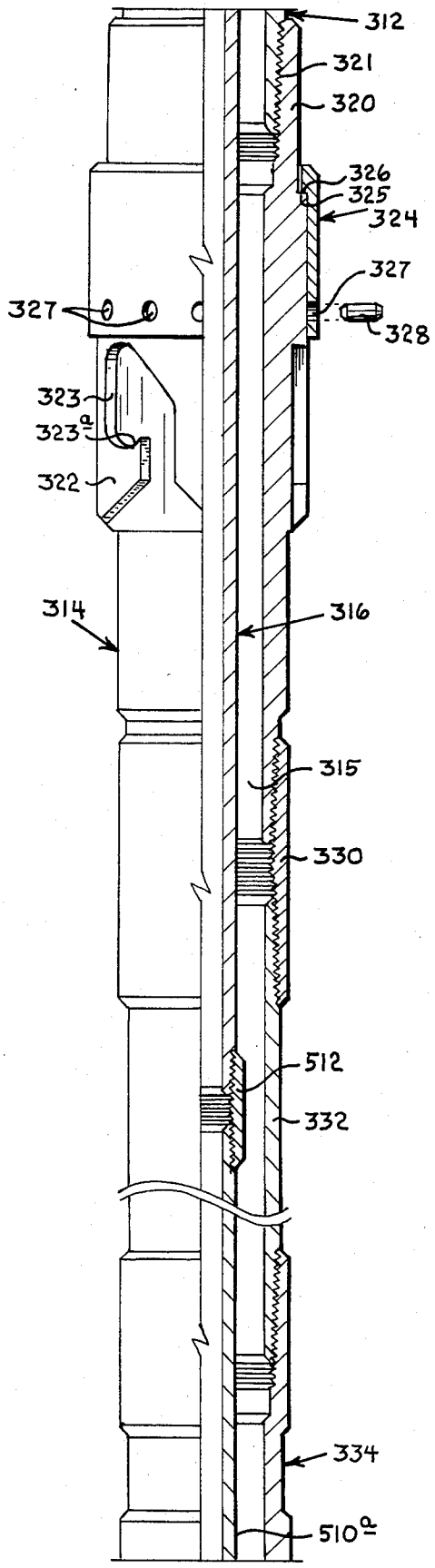
Figure 7F:
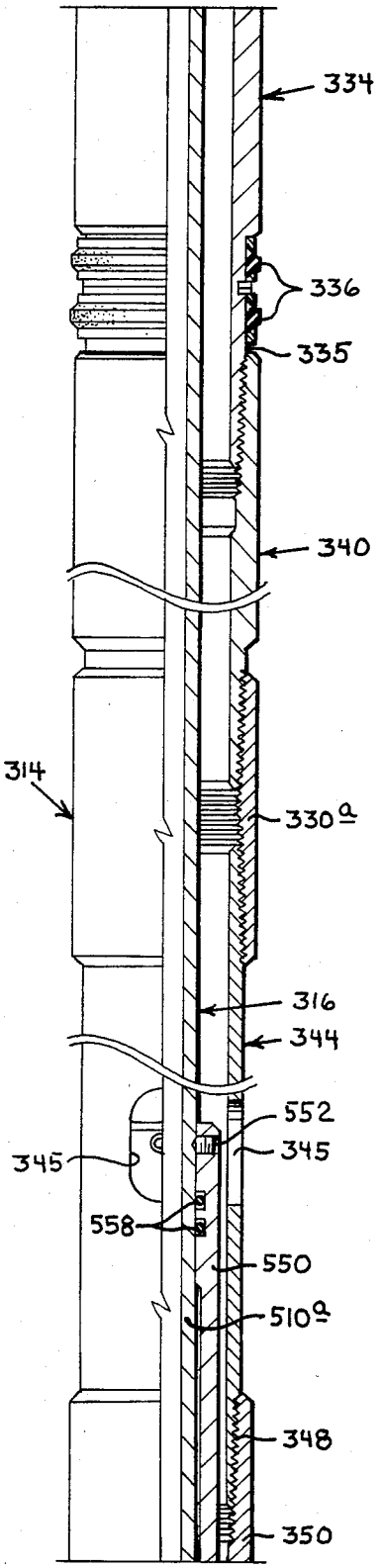
Figure 7G:
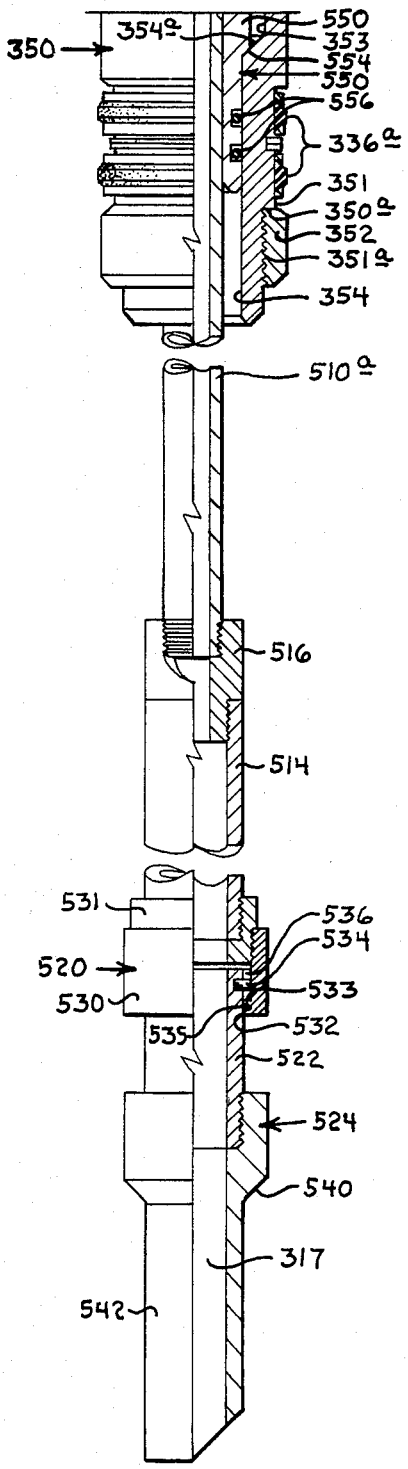

Assuming the tubing remains in its lifted position and is holding valve 310 open, the tubing is further lifted, applying a load to shear the shear screws 398 which until now have held the telescoping joint 312 in the retracting position (see FIGS. 7C and 7D). When this load, as a result of lifting the tubing, reaches a predetermined magnitude, the shear screws 398 will fail. This same tensile load was also applied to the shear pins 328 holding the tool 300 secured to the packer but they remain intact, either because the load was borne by the J-slot and pin connection, or because these pins 328 have a total shear value somewhat greater than that of shear screws 398.

The shearing of shear screws 398 permits the tubing to be further lifted, thus extending the telescoping joint. The telescoping joint permits lifting of the wash pipe 316 a limited distance (equal to the stroke of the telescoping joint) without disconnecting the tool 300 from the packer.

Upon shearing of the shear screws 398 of the telescoping joint, the tubing is lifted to extend the telescoping joint to its full length wherein the upper end 394 of plunger packing mandrel 383 engages the lower end 395 of sub 365 of the telescoping joint.

Lifting of the tubing in this manner also lifts the wash pipe 316 which is attached to the valve 310. When the wash pipe is thus lifted, the packing sleeve 550 is lifted out of sealing engagement with the restricted bore 354 of lower packing mandrel 350 at the lower end of tool body 314. The packing sleeve 550 is at this time held several inches above the packing mandrel 350. This unseals the upper end of the main screen. Also, lifting of the tubing as just explained lifts the locator sub 524 at the lower end of the wash pipe 316 out of sealing engagement with the restricted bore of the restricted packing nipple at the upper end of the telltale screen.

Thus, lifting the tubing to shear the shear screws 398 and to extend the telescoping joint as just explained establishes a new fluid flow circuit through which cleanout fluids may be circulated, by reverse circulation, to clear the well and apparatus of excess gravel. Thus, cleanout fluids may be pumped from the surface down the tubing-casing annulus, into valve 310, through its lateral slot 431, down the wash pipe, out the lower end thereof, upward around the wash pipe, and through the packer and well tubing to the surface.

When treatment of the well has been accomplished and it is desired to remove the tool 300 from the well, the tubing is lowered to provide slack in the J-slot mechanism, then the tubing is rotated in a direction to unjay the J-slot mechanism and lifted again. This lifting unjays the J-slot from the packer pins, opens valve 310, and extends telescoping joint 312. Further lifting of the tubing will shear the shear pins 328 and allow the tool 300 to be lifted free of the packer and withdrawn from the well. Normally, a production seal nipple is then attached to a string of tubing and installed as before explained with respect to FIG. 6 and the well placed on production.

It should be understood that had the locator sub 524 at the lower end of wash pipe 316 been fouled, as by the settling of fine solid particles such as sand or fine gravel fragments, around and above it, an upward pull on the wash pipe 316 sufficient to shear the shear means 534 in the swivel shear sub or safety joint 520 would have caused the wash pipe to part at the safety joint, enabling the apparatus to be withdrawn from the well leaving the locator sub 524 and very short section of pipe 522 fouled in place in the well. Of course, removal of the excess gravel would have been carried out as described above, and fouling of the lower end of the wash pipe would not have come to light until removal of the apparatus revealed the missing of the parts below the safety joint.

It is readily understood that before the shear screws 398 of the telescoping joint 312 are sheared, the valve 310 may be opened and closed as many times as necessary merely by lifting and lowering the tubing. Lifting of the tubing opens the valve and establishes a first fluid flow path to permit circulation through the apparatus. Lowering the tubing closes the valve and interrupts the return flow from the apparatus, enabling the safe application of higher pressure through the apparatus to the formation as in the injection of treating medium into the formation without subjecting the casing above the packer to such higher pressure.

It should be understood that repeated operation of the telescoping joint 312 is not ordinarily desirable since pressure applied through the tubing to the apparatus could lift or partially extend the telescoping joint and cause the treating fluids, probably acid, to take a questionable path, since extending the telescoping joint as by lifting the tubing changes the fluid flow circuit as has been made clear hereinabove.

In many cases, it may be desirable to acidize or perform other treating operations before or after the excess gravel has been removed from the well. In such cases, a modified form of telescoping joint may be used. Such modified telescoping joint could safely be used repeatedly.

Figure 10:
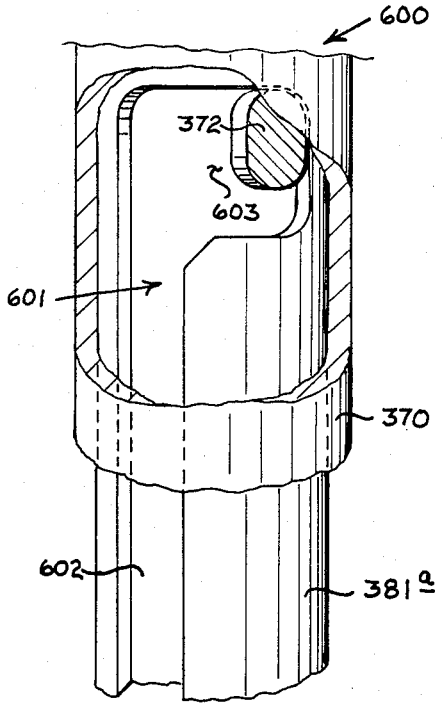
FIG. 10 is a fragmentary view showing an L-slot and pin arrangement for controlling the lost motion mechanism of the service seal unit tool of FIGS. 7A–7G.

The modified telescoping joint is seen in FIG. 10 where it is indicated generally by the reference numeral 600.

The telescoping joint 600 may be exactly like the telescoping joint 312 with the exception that a modified upper plunger member 381*a* permits the telescoping joint to be latched in retracted position. The barrel 370 may be exactly like the barrel 370 of the telescoping joint 312.

The modified upper plunger member 381*a* has a keyway 601 having a long vertical or longitudinal leg 602 which may be exactly like the keyway 392 of upper plunger member 381, previously described but with one difference.

The keyway 601 also has a horizontal or transverse leg 603 as shown. As seen in FIG. 10, the key 372 of the barrel 370 occupies this horizontal leg 603 of the keyway 601, and since it is not aligned with the vertical leg 602, the telescoping joint 600 cannot be extended at this time even with a substantial lifting force applied to the tubing.

In order to extend the telescoping joint 600 and lift the tubing to establish a different fluid flow circuit, the tubing must be rotated in a direction (clockwise in this case) to rotate the barrel 370 and bring key 372 into alignment with the vertical leg 602 of the keyway 601. Then, the tubing can be lifted to extend the telescoping joint in the manner before explained.

When the tubing is afterwards lowered to retract the telescoping joint and re-establish the former fluid flow circuit, the tubing is then rotated in the opposite direction to place key 372 in the horizontal leg of the keyway 601 as seen in FIG. 10 to again lock the telescoping joint in its retracted position. Locking and unlocking of the telescoping joint may be repeated as many times as desired.

The foregoing description and drawings have been presented herein by way of explanation only, and variations in shapes, sizes, and arrangement of parts may be had by those skilled in the art without departing from the true spirit of the invention.

We claim:

1. A service seal unit tool for setting a packer and screen in place in a well and establishing circuits for circulating fluids therethrough for treating the well therebelow with treating media and removing excess treating media from the well, including:

a. means for connecting the service seal unit tool to a pipe string and to the packer for setting the packer in the well, there being provided lateral port means between the packer and the screen;

b. means sealing between the service seal unit tool and the packer above and below the lateral port means;

c. lost motion means providing limited relative longitudinal movement between the pipe string and the packer while the two remain connected together and while said seal means remain substantially unmoved;

d. means establishing a first circuit for circulating fluids from the surface downward through the packer and the lateral port means to the exterior of the screen, thence through the screen, and upward through the packer to the surface; and e. means establishing a second circuit in response to longitudinal movement of the pipe string relative to the packer for circulating fluids from the surface downward through the packer and upward therethrough to the surface.

2. The service seal unit tool of claim 1 wherein said means connecting the tool to the packer is releasable.

3. The service seal unit tool of claim 2 wherein said means sealing between the tool and the packer are carried on the tool.

4. The service seal unit tool of claim 3 wherein said releasable means includes a shear pin.

5. The service seal unit tool of claim 4 wherein said lost motion means comprises telescoped relatively longitudinally movable members having coengageable shoulder means for limiting such relative movement.

6. The service seal unit tool of claim 5 wherein said means for establishing said fluid circuits includes wash pipe means having its lower end opening into said screen and its upper end opening through the side of the tool into the tool-casing annulus above said packer.

7. The service seal unit tool of claim 6 wherein the upper end of said wash pipe means is above said lost motion means and means is provided for sealing between said wash pipe means and said screen, said wash pipe means being liftable out of sealing engagement with said screen upon lifting said pipe string to extend said lost motion means.

8. The service seal unit tool of claim 7 wherein the portion of said tool carrying said means for sealing between said tool and said packer extends below said lateral port means of said packer and is provided with lateral openings communicating with said lateral port means.

9. The service seal unit tool of claim 8 including means sealing between such relatively movable parts of said lost motion means.

10. A service seal unit tool for setting a packer and screen means in place in a well and establishing circuits for circulating fluids therethrough for treating the well with treating media and removing excess treating media from the well, including:

a. means for releasably connecting the service seal unit tool to a pipe string and to the packer for setting the packer in the well, there being provided lateral port means between the packer and the screen means;

b. means sealing between the tool and the packer above and below the lateral port means;

c. lost motion means providing limited relative longitudinal movement between the pipe string and the packer while the two remain connected together and while said seal means sealing between said tool and said packer remain substantially unmoved;

d. means establishing a first circuit for circulating fluids from the surface downward through the packer, outward through the lateral port means to the exterior of the screen, through the screen means and upward to the surface;

e. means establishing a second circuit in response to longitudinal movement of the pipe string relative to the packer to extend said lost motion means for circulating fluids from the surface downward through the packer and upward therethrough to the surface; and f. means for interrupting flow through said first circuit to prevent flow of fluids upwardly from said tool to the surface.

11. The service seal unit tool of claim 10 wherein said means for establishing said fluid circuits includes wash pipe means having its lower end opening into the interior of said screen and its upper end opening through the side of said tool into the tool-casing annulus above said packer.

12. The service seal unit tool of claim 11 wherein said means for interrupting flow through said first circuit includes valve means for controlling flow through said flow tube means.

13. The service seal unit tool of claim 12 wherein said valve means for controlling flow through said flow tube means is a sleeve valve comprising relatively movable telescoped members having port means therein and including shoulder means for limiting the stroke of said relatively movable members, said port means being open at one end of the stroke.

14. The service seal unit tool of claim 13 wherein one of said relatively longitudinally movable members of said valve means is provided with control slot means and the other member carries a rotatable ring having a control pin engaged in said control slot means, said slot means controlling the longitudinal movement of said control pin and providing long and short upstrokes for indexing said valve means, whereby said valve may be opened in response to a long upstroke and remain locked closed during a short upstroke.

15. The service seal unit tool of claim 14 wherein said lost motion means comprises telescoped relatively longitudinally movable members having coengageable shoulder means for limiting such relative movement.

16. The service seal unit tool of claim 15 wherein a shear pin initially secures said telescoping joint in its retracted position and wherein said shear pin is shearable upon lifting said pipe string, permitting said telescoping joint to be extended.

17. The service seal unit tool of claim 16 wherein said wash pipe means extends into said screen and a packing sleeve is attached about the wash pipe means and carries seal means for sealing between the wash pipe means and the screen and between the wash pipe means and the packing sleeve.

18. The service seal unit tool of claim 17 wherein seal means is provided for sealing about said wash pipe means at a point intermediate the ends of said screen, said wash pipe means having its lower end opening into the lower portion of said screen means.

19. The service seal unit tool of claim 18 wherein said wash pipe means includes a safety joint connected therein between said packing sleeve and said means sealing about the lower end of said flow tube means, said safety joint comprising telescoped tubular members releasably connected together with at least one shearable member and having means sealing between such telescoped members, said shearable member being shearable when the tensile load on said safety joint reaches a predetermined value to permit retrieval of said tool while leaving the extreme lower portion of the wash pipe means in the well.

20. The service seal unit tool of claim 16 including coengageable means on said relatively movable members for latching said members in retracted position and being releasable on relative rotational movement therebetween for movement toward extended position.

21. The service seal unit tool of claim 20 wherein said coengageable latching means is relatchable.

22. The service seal unit tool of claim 21 wherein said latching means includes an L-slot, having a longitudinal leg and a transverse leg, on one and a control pin on the other of said relatively movable members coengageable for latching said relatively movable members in retracted position when said pin occupies said transverse leg of said L-slot and permitting said relatively movable members to be moved to extended position by lifting said pipe string when said control pin occupies said longitudinal leg of said L-slot.

23. The service seal unit tool of claim 22 wherein said wash pipe means extends into said screen and a packing sleeve is attached about the wash pipe means and carries seal means for sealing between the wash pipe means and the screen and between the wash pipe means and the packing sleeve.

24. The service seal unit tool of claim 23 wherein seal means spaced below said packing sleeve is provided for sealing between said wash pipe means and said screen, said wash pipe means having its lower end opening into the lower portion of said screen means.

25. The service seal unit tool of claim 24 wherein said wash pipe means includes a safety joint connected therein between said packing sleeve and said means sealing about the lower end of said wash pipe means, said safety joint comprising telescoped tubular members releasably connected together with at least one shearable member and having means sealing between such telescoped members, said shearable member being shearable when the tensile load on said safety joint reaches a predetermined value to permit retrieval of said tool while leaving the extreme lower portion of the wash pipe means in the well.

26. The method of treating a well penetrating an earth formation and having a well casing installed therein and perforated opposite the formation, comprising the steps of:

a. attaching a well screen to the lower end of a well packer, there being provided lateral openings between said packer and said screen;
b. attaching said packer and screen to a service seal unit tool, said tool having seals engaging the bore wall of said packer;
c. attaching said service seal unit tool to a pipe string;
d. lowering said pipe string into said well;
e. setting said packer above said casing perforations;
f. lifting the pipe string relative to said packer to a first level and circulating treating fluids in a first direction downward through said packer and ports to the exterior of said screen, through said screen, and from the interior of said screen upward to the surface; and
g. lifting the pipe string to a higher, second level relative to said packer to change the circulating path to permit circulating fluids in a reverse direction from the surface downward through said packer and upward to the surface while said service seal unit tool remains attached to said packer, said lifting of said pipe being accomplished while said tool seals remain substantially unmoved in said packer bore.

27. The method of claim 26, including the further steps of:

a. releasing said service seal unit tool from said packer; and
b. removing said pipe string and said service seal unit tool from said well.

28. The method of claim 27, including the further steps of:

a. making up a production seal nipple on the lower end of a production tubing string, said production seal unit having seals engageable with said packer;
b. lowering said tubing string into said well and sealingly engaging said seal nipple in said packer; and
c. producing said well through said seal nipple and tubing string.

29. The method of claim 26 wherein the steps of circulating fluids in said first and second directions is repeated any number of times while said service seal unit tool remains attached to said packer and said tool seals remain substantially unmoved.

30. The method of claim 26, including the additional steps of:

a. lowering the pipe string, after fluids have been circulated in said first direction, to interrupt flow of fluids upward to the surface; and
b. injecting fluid into the formation through the casing perforations.

31. The method of claim 30 wherein the fluid injected into the formation is acid.

32. The method of claim 27 wherein gravel is deposited exterior of the screen by circulation of gravel-laden fluid in said first direction.

33. Apparatus for treating a well, including:

a. a packer connectable to a pipe string and having a screen connected to its lower end, there being provided ports between said packer and screen; and
b. a service seal unit tool for setting the packer and carrying out treating operations in the well therebelow, including:
   i. means for connecting the service seal unit tool to a pipe string and to said packer for setting the packer in the well;
   ii. means sealing between the tool and the packer both above and below said ports;
   iii. lost motion means providing limited relative longitudinal movement between the pipe string and the packer while the two remain connected together and while said seals remain substantially unmoved;
   iv. means establishing a first circuit for circulating fluids from the surface downward through the packer and the ports to the exterior of the screen, thence through the screen, and upward through the packer to the surface; and
   v. means establishing a second circuit in response to lifting the pipe string relative to the packer as permitted by said lost motion means for circulating fluids from the surface downward through the packer and upward therethrough to the surface.

34. The apparatus of claim 33 wherein said lost motion means is initially releasably held in contracted position by holding means, said holding means being releasable in response to a predetermined upward force applied to one of the telescoped tubular members, permitting said lost motion means to be actuated to extended position.

35. The apparatus of claim 34 wherein said service seal unit tool further includes valve means for controlling flow through said first circuit between said packer and the surface, said valve being openable by lifting the pipe string and closable by lowering the pipe string.

* * * * *